US009803906B2

(12) United States Patent
Ko

(10) Patent No.: US 9,803,906 B2
(45) Date of Patent: Oct. 31, 2017

(54) SNOW ICE MAKER

(71) Applicant: IceCapGlobal Co., Ltd., Seongnam-si (KR)

(72) Inventor: Daea Ju Ko, Seongnam-si (KR)

(73) Assignee: IceCapGlobal Co., Ltd., Seongnam-si (KR)

( * ) Notice: Subject to any disclaimer, the term of this patent is extended or adjusted under 35 U.S.C. 154(b) by 278 days.

(21) Appl. No.: 14/764,574

(22) PCT Filed: Jan. 27, 2014

(86) PCT No.: PCT/KR2014/000744
§ 371 (c)(1),
(2) Date: Jul. 30, 2015

(87) PCT Pub. No.: WO2014/119887
PCT Pub. Date: Aug. 7, 2014

(65) Prior Publication Data

US 2015/0362243 A1 Dec. 17, 2015

(30) Foreign Application Priority Data

Jan. 30, 2013 (KR) ..... 10-2013-0010590

(51) Int. Cl.
*F25C 1/10* (2006.01)
*F25C 1/14* (2006.01)

(52) U.S. Cl.
CPC ..... *F25C 1/10* (2013.01); *F25C 1/142* (2013.01)

(58) Field of Classification Search
CPC ... F25C 1/14; F25C 1/10; F25C 1/142; A23G 9/18; A23G 9/222
See application file for complete search history.

(56) References Cited

FOREIGN PATENT DOCUMENTS

KR 10-0178693 11/1998
KR 10-0821558 4/2008
(Continued)

OTHER PUBLICATIONS

International Search Report Dated Feb. 19, 2015 From the Korean Intellectual Property Office Re. Application No. PCT/KR2014/000744.

*Primary Examiner* — Cassey D Bauer

(57) ABSTRACT

The present invention relates to a snow ice maker, comprising a coupling shaft (40) assembly wherein refrigerant injection capillary tubes (20) and a refrigerant gas outlet tube (30) are arranged in a main passage (41), and the passage (41) is closed at a welding part (43) as a result of the capillary tubes (20) and a refrigerant gas inlet tube being simultaneously provided. The refrigerant injection capillary tubes (20) comprise ends (22) arranged in proximity to an injecting position inside a cooling drum, and the refrigerant injection capillary tubes (20) are arranged by collecting the refrigerant injection capillary tubes (20) in the passage (41) of the coupling shaft (40); extending the refrigerant injection capillary tubes (20) to the outside of the cooling drum; combining the refrigerant injection capillary tubes (20) at a multiple connection part (21); and directly connecting the refrigerant injection capillary tubes (20) to a refrigerant supply tube (52) of a refrigerant compressor. The refrigerant gas outlet tube (30) is connected to a multiple inlet tube (33) in an ice-making drum, and the refrigerant gas outlet tube (30) is arranged by directly connecting the refrigerant gas outlet tube (30) through the main passage in the coupling shaft (40), from a connection part (31) outside the cooling drum to a gas inlet tube (54) of a condenser. According to the present invention, clean snow ice can be used because supplied water for ice making is frozen in an ice-making drum, edible powder ice can be obtained by cutting the ice layers of the ice-making drum with a cutter, and water for ice
(Continued)

making is sterilized by ultraviolet rays. In addition, the ice-making drum can be cleaned and sterilized by heated water and vapor so that ingredients including milk, sugar and juice can be ice-made and variously used in a summer environment of high temperature and humidity.

9 Claims, 10 Drawing Sheets

(56) References Cited

FOREIGN PATENT DOCUMENTS

| | | |
|---|---|---|
| KR | 10-2012-0126488 | 11/2012 |
| WO | WO 2014/119887 | 8/2014 |

SNOW ICE MAKER

RELATED APPLICATIONS

This application is a National Phase of PCT Patent Application No. PCT/KR2014/000744 having International filing date of Jan. 27, 2014, which claims the benefit of priority of Korean Patent Application No. 10-2013-0010590 filed on Jan. 30, 2013. The contents of the above applications are all incorporated by reference as if fully set forth herein in their entirety.

TECHNICAL FIELD

The present disclosure relates to a snow ice maker, and more particularly to an ice maker which cools a rotating drum by vaporizing a refrigerant in the rotating drum, applies and freezes water on the surface of the drum, and then makes powder ice, namely, snow ice by cutting the ice layer frozen on the surface of the drum by means of a knife.

BACKGROUND ART

A drum type ice maker is disclosed in Korean Patent Application Laid-Open No. 0178693. The drum type ice maker applies and freezes water on the surface of the drum, and then makes piece ice by cutting the ice layer frozen on the surface of the drum by means of a knife. Since the drum ice maker makes powder ice by directly cutting the ice layer in the ice making drum, the powder ice made by the drum ice maker is softer than the existing particle ice made by splitting ice mass by using a crusher or by cutting the ice mass by using a cutting tool, and has uniform particles, so that high-quality powder ice can be obtained and used for food.

The ice maker freezes water by using a refrigerant. An ice cream maker, a refrigerator and a freezer include an ice making device. The ice making device absorbs vaporization heat while vaporizing the refrigerant in an evaporator. The evaporator is cooled with the loss of the vaporization heat. The refrigerant which has a temperature increased by absorbing the vaporization heat from the evaporator radiates the absorption heat in a condenser, and then turns into a refrigerant liquid. As such, the refrigerant circulates in a cooling cycle in which the refrigerant is compressed by a compressor, is vaporized and injected into the evaporator, and then is liquefied again in the condenser.

Since the refrigerant evaporator of a general ice making device is manufactured in the form of a heat exchange coil, there is no possibility that the refrigerant remains in the evaporator. Meanwhile, in the particle ice maker in which the evaporator is made by means of the ice making drum, the liquefied refrigerant remains and accumulates in the rotating drum.

The refrigerant remaining in the rotating drum interrupts the heat exchange operation of the drum, so that cooling efficiency is reduced and the ice making drum and compressor have a shorter lifespan. This structural condition increases the manufacturing cost of the ice maker and causes a failure.

Also, in the particle ice maker, the refrigerant is injected within the ice making drum and the refrigerant gas is sucked within the ice making drum.

Specifically, in a conventional particle ice maker, a means for circulating the refrigerant in the ice making drum is made in the form of a layered pipe comprised of a first flow path of an outer pipe and a second flow path of an inner pipe which is disposed at the center of the outer pipe. The layered pipe is assembled to the center of a gas block seal tube on a side of the ice making drum. The compressed refrigerant is supplied to the inside of the ice making drum through the first flow path from the external compressor, and the refrigerant gas vaporized in the drum is exhausted to the external condenser through the second flow path. Several holes are formed in the outer wall of the layered pipe located in the ice making drum, and a capillary tube is assembled to each of the holes. Therefore, the refrigerant supplied from the first flow path of the outer pipe is injected to the inner surface of the rotating drum through the capillary tube, and the vaporized refrigerant gas is exhausted to the condenser through the inner pipe. In the refrigerant circulator, since the layered pipe has a complex structure and is vulnerable to failure, for example, flow path blocking, the manufacturing cost and operation cost are increased.

A recent problem is that a material including milk, sugar, juice, etc., is used to make ice, so that it is difficult to maintain the ice maker clean. Especially, the residue of milk, sugar, etc., remaining in the ice maker is apt to be easily decayed in a high temperature humidity environment in summer, and causes highly serious problems.

SUMMARY OF THE INVENTION

The present invention provides a snow ice maker including a refrigerant circulator of an ice making drum (a drum evaporator), which is integrally formed with a coupling shaft.

The present invention provides the snow ice maker in which, in the refrigerant circulator, the rears of the capillary tubes of which the end is disposed close to the inner wall of the ice making are collected to the passage of the coupling shaft and are extended to the outside of the ice making drum, so that the refrigerant is directly supplied from a refrigerant supply tube of the compressor to the capillary tubes.

The present invention provides the snow ice maker in which a gas outlet tube exhausting the refrigerant gas in the ice making drum is disposed in the passage of the coupling shaft and is extended to the outside of the ice making drum, so that the refrigerant is directly exhausted to a gas inlet tube of the condenser.

The present invention provides the snow ice maker in which the capillary tubes and the gas outlet tube are disposed in the central passage of the coupling shaft, and simultaneously, the capillary tubes and the gas outlet tube are integrally welded with the coupling shaft, and thus, are formed in the form of a coupling shaft assembly.

The present invention provides the snow ice maker which sterilizes the ice making drum and ice making water by irradiating ultraviolet rays to the surface of the ice making drum and the supplied ice making water.

The present invention provides the snow ice maker which is capable of washing and sterilizing the ice making drum by heated water and vapor in order to maintain the cleanness while variously using a material including milk, sugar, juice, etc., in the ice-making in a high temperature humidity environment in summer.

TECHNICAL SOLUTION

One embodiment is a snow ice maker that includes: an ice making drum which is installed horizontally to an ice maker cabinet frame; a driver 90 which is connected and assembled to a first surface of the ice making drum and rotates the drum; a seal tube 81 assembled to a second surface of the ice making drum; a compressor 51 which compresses a refrigerant supplied from a condenser and supplies to the ice making drum (evaporator); the condenser 53 which condenses refrigerant gas exhausted from the ice making drum and returns it to the compressor; an ice making water vessel 70 which applies water on the ice making drum; and a cutter 60 which cuts an ice layer 71*i* frozen on the surface of the ice making drum.

The snow ice maker according to the embodiment of the present invention includes: a coupling shaft 40 assembly in which refrigerant injection capillary tubes 20 and a refrigerant gas outlet tube 30 are disposed in a central passage 41, and the capillary tubes 20 and the refrigerant gas outlet tube 30 are integrally attached to the passage 41 by a welding part 43, and simultaneously, the passage 41 is sealed;

an arrangement structure of the capillary tubes 20, in which the rears of the capillary tubes 20 of which ends 22 are disposed respectively close to an injection position of the inner wall of the cooling drum, are collected to the passage 41 of the coupling shaft 40 and are extended to the outside of the cooling drum, and then are integrated and directly connected to a refrigerant supply tube 52 of the refrigerant compressor by a multiple connection part 21; and an arrangement structure of the outlet tube 30 in which the outlet tube 30 extending from a multiple inlet tube 33 disposed to collect the refrigerant gas within the ice making drum is extended to the outside of the cooling drum through central passage of the coupling shaft 40 and is assembled and directly connected to a gas inlet tube 54 of the condenser by a connection part 31.

Since the coupling shaft 40 assembly has a configuration in which the capillary tubes 20 receive directly the refrigerant from the refrigerant supply tube 52 and injects the refrigerant within the ice making drum 10, it is possible to solve the complexity of the configuration and the complexity of the assemblage caused by the assemblage of the layered pipe in a conventional ice making drum 10. The refrigerant is easily uniformly injected and supplied within the ice making drum, so that the ice making performance is improved. Also, the coupling shaft 40 assembly causes the core parts which determine the freezing performance of the ice making drum to be managed as a single part, so that it is easy to manage the quality of the product.

In the arrangement structure of the capillary tubes 20, since direct connection is made from the multiple connection part 21 to the ends 22, it is possible to exclude a possibility that obstacles occur in the flow path of the refrigerant while the refrigerant passes through the coupling shaft 40. Likewise, in the arrangement structure of the outlet tube 31, since the outlet tube is directly connected from the multiple inlet tube 33 to the connection part 31, the refrigerant gas passing through the coupling shaft 40 is easily exhausted and exhaust resistance is reduced.

The multiple inlet tube 33 installed within the ice making drum 10 is a curved tube having a U-shape.

Since the multiple inlet tube 33 sucks all liquefied refrigerant staying on the bottom of the ice making drum 10, it is possible to prevent the cooling performance of the ice making drum from being degraded and to improve the performance of the compressor. Specifically, the U-shaped multiple inlet tube 33 includes a first inlet 34 which sucks the refrigerant gas at the end of the U-shaped tube, a second inlet 35 which is adjacent to the bottom of the drum and sucks non-vaporized refrigerant liquid, and a third inlet 36 which is a U-shaped tube neck and assists the suction of the refrigerant gas. The third inlet may be omitted.

In the snow ice maker according to the embodiment of the present invention, an ultraviolet lamp 75 is installed in the cooling water vessel 70, so that the cooling water is sterilized and the manufactured powder ice (si) can be maintained clean.

A washing device 200 is further provided in the ice making drum 10 of the snow ice maker according to the embodiment of the present invention.

The washing device 200 is driven by the control of a microcomputer 101 and sprays heated water and vapor onto the surface of the ice maker drum 10. For the cleaning function of the ice maker drum, there is a need to pull the ice making water vessel 70 out of the ice maker prior to the execution of cleaning control. For this, proposed is a structure in which the ice making water vessel 70 is separably assembled to the frame F. Also, there is a special consideration for the ice making water vessel which can be easily separated and assembled.

A drain 206 of the bottom of an ice vessel 65 is opened during the cleaning operation such that the water used in cleaning is easily drained. The drain is closed after the washing of the drum is ended and all remaining water is drained. Because of these considerations, a drain opening closing valve 207 is installed such that the drain 206 is opened and closed by the control of the microcomputer.

ADVANTAGEOUS EFFECTS

As such, according to the embodiment of the present invention, the capillary tubes and gas outlet tube, which are core components of the refrigerant circulator of the ice making drum, are welded to the coupling shaft 40, and then integrally formed in the form of one part. The capillary tubes of which the ends are disposed close to the inner wall of the ice making drum are extended to the outside of the ice making drum through the passage of the coupling shaft 40, and then are directly connected to the refrigerant supply tube. The refrigerant gas outlet tube of the ice making drum is extended to the outside of the ice making drum through the passage of the coupling shaft 40 and are directly connected to the gas inlet tube, so that the ice making performance is improved and the core parts of the ice making device are managed as a single part, and thus, the quality of the ice maker can be easily managed and it is possible to easily manufacture and assemble a cooling drum ice maker. Furthermore, according to the embodiment of the present invention, the ice making water is sterilized by ultraviolet rays, so that sanitized powder ice can be manufactured. Also, according to the embodiment of the present invention, the ice making drum is washed and sterilized by means of heated water and vapor, a material including milk, sugar, juice, etc., can be variously used in a clean state in the ice making in a high temperature humidity environment in summer.

REFERENCE NUMERALS

10: ice making drum, 11: support shaft, 12: bearing, 13: cooling room, 14: entrance, 20: capillary tube, 21: multiple-connection part, 22: end portion, 30: gas outlet tube, 31: connection part, 33: multiple inlet tube, 34: first inlet, 35: second inlet, 36: third inlet, 40: coupling shaft, 41: passage, 43: welding part, 51: compressor, 52: supply tube, 53: condenser, 54: gas inlet tube, 56: connection part, 60: cutter, 61: cutter frame, 62: cut opening, 63: knife, 65: ice vessel, 70: ice making water vessel, 71: ice making water, 75 and 75*b*: ultraviolet lamp, 77: ice making water pump, 78: transparent tube, 81: seat tube, 82: bearing, 83: screw, 84: first room, 85: second room, 86: spring, 87: cover, 88: space, 90: driver, 100: controller, 101: microcomputer, 104: displayer, 105: drive switch

200: washing device, 201: washing switch, 206: drain, 207: drain opening closing valve, 210: injection support, 211: ice making water vessel detection switch, 220: vapor generator, 221: cleaning nozzle, 222: water inlet tube, 223: injection tube, 224: heating room, 271: inner rim, 272: recess, 230: electric heater, 231: temperature sensor, 232: heater switch, 233: temperature fuse, 273: support plate, 274: magnet, 280: wash water pump, 280*s*: driving driver, 281: wash water, s1: wash request signal, s2: temperature signal, s3: ice making water vessel detection signal, c1: ice making drum control signal, c2: wash water pump control signal, c3: heater control signal, c4: drain opening closing valve driving signal, and F: frame.

DESCRIPTION OF SPECIFIC EMBODIMENTS OF THE INVENTION

The embodiment of the present invention will be described in more detail as follows with reference to the accompanying drawings.

Figure 1:
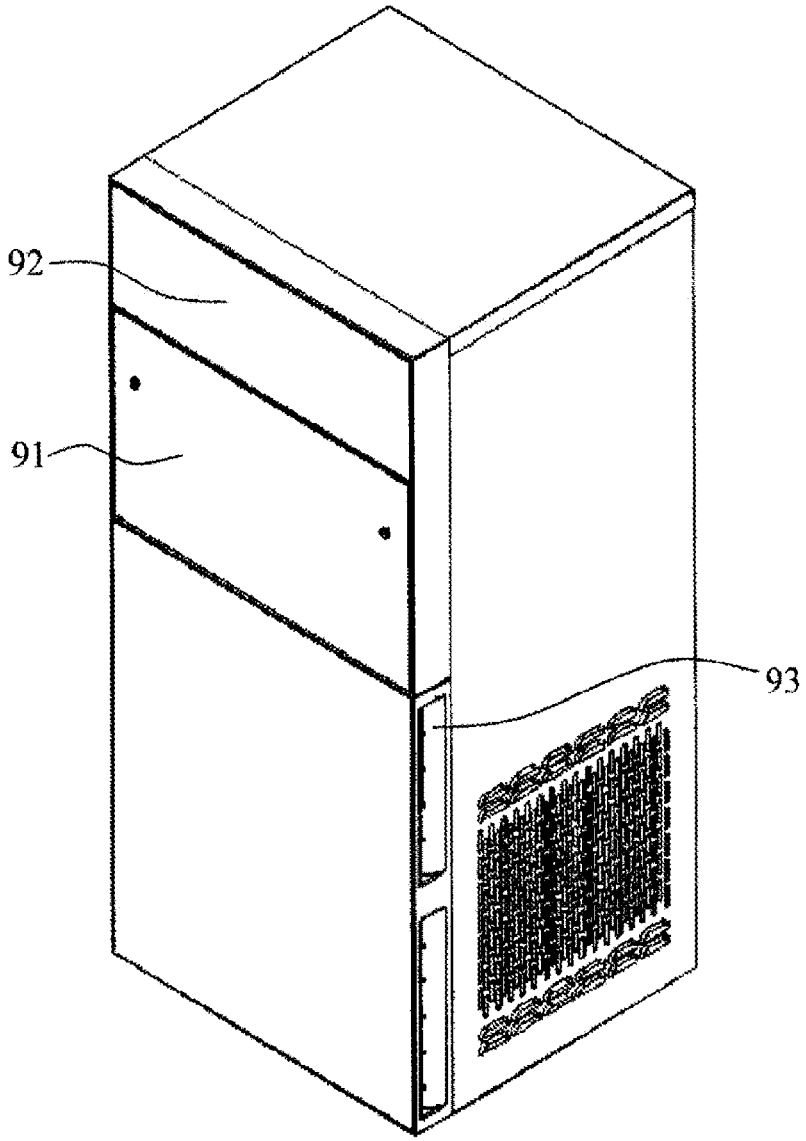
FIG. 1 is a perspective view of a snow ice maker.
Figure 2:
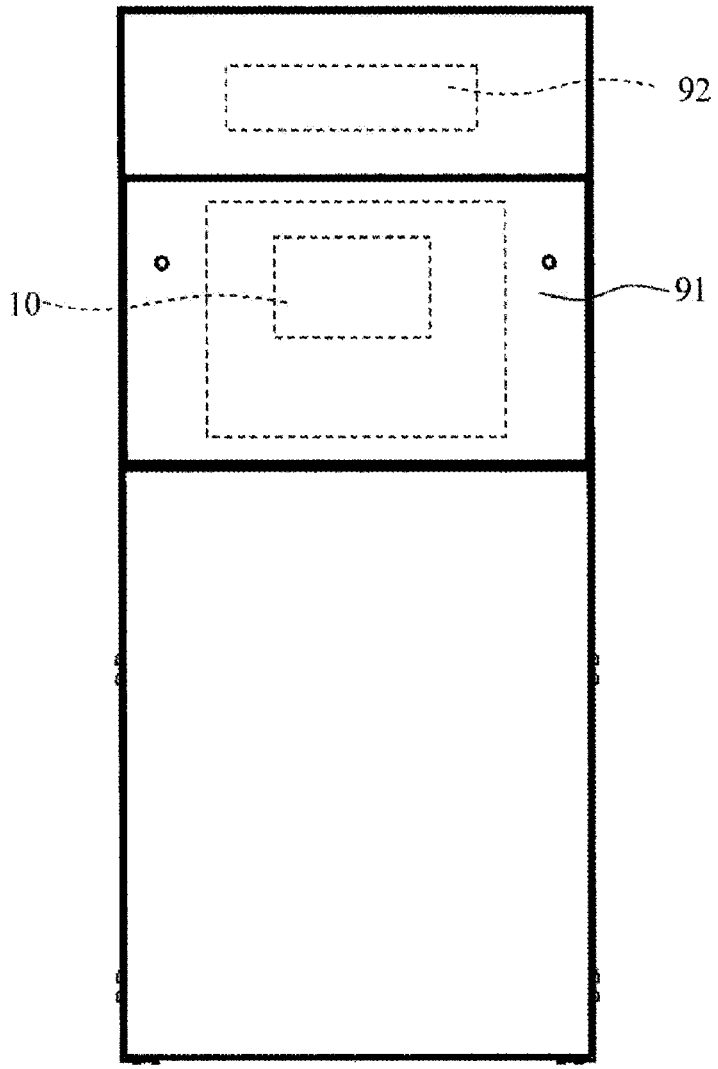
FIG. 2 is a front view of the snow ice maker.
Figure 3:
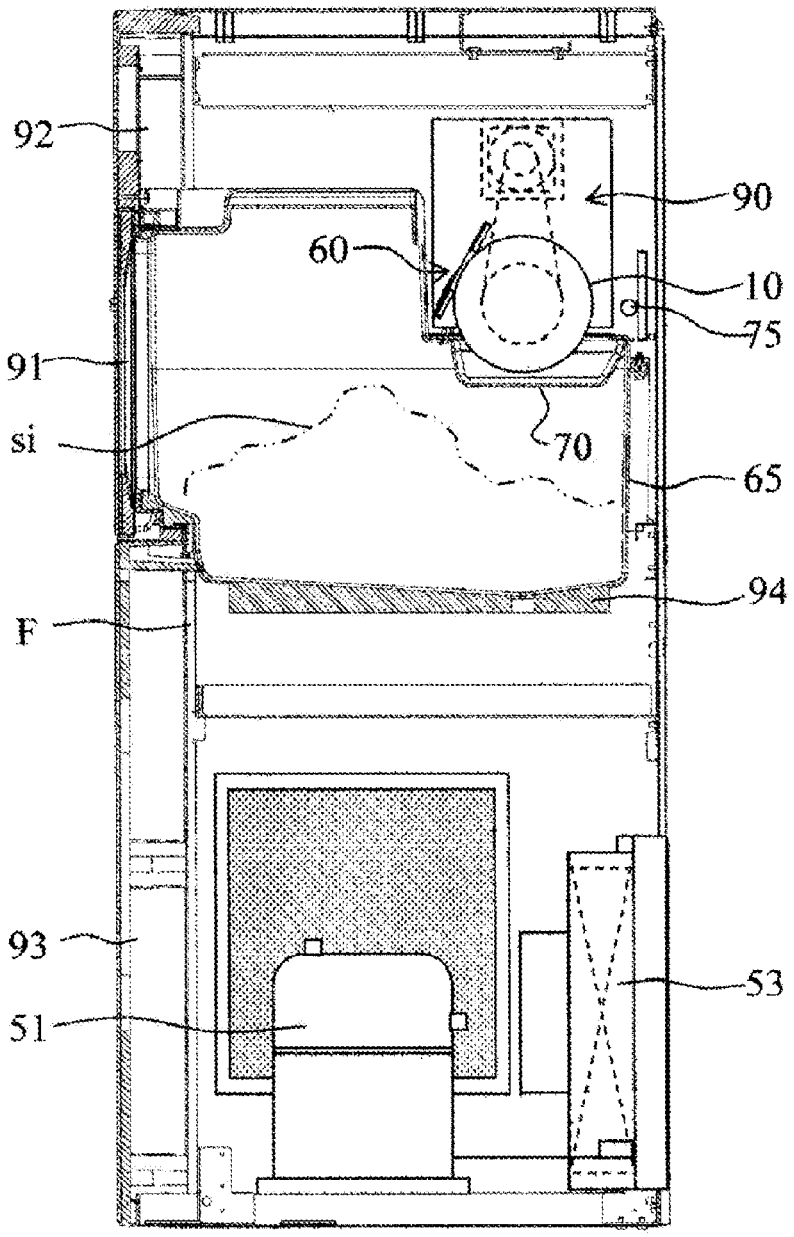
FIG. 3 is a cross-sectional side view of the snow ice maker.

FIG. 1 is a perspective view of a snow ice maker according to the embodiment of the present invention. FIG. 2 is a front view of the snow ice maker. FIG. 3 is a cross-sectional side view of the snow ice maker. In the microcomputer 101 of the controller 100 in the front head of an ice maker cabinet, the displayer 104 which displays a state and the drive switch 105 comprised of a proximity switch are covered with a translucent plate or a transparent plate 92. The displayer 104 includes a power on/off state display lamp, an operating time displayer, and a display lamp of the drive switch 105, etc., and is driven by the control of the microcomputer 101.

A door 91 of an ice making room is installed under the transparent plate 92. The ice making drum 10 set and the ice vessel 65 are installed in the ice making room which is opened by the door 91, so that the manufactured snow ice (powder ice) (si) is collected in the ice vessel 65. A user opens the door and takes some snow ice out of the ice vessel. The snow ice can be used as an adzuki-bean ice dessert material, edible powder ice which is put into the drink, or powder ice for beauty or treatment, etc. A thermal insulation material 94 is installed on the ice vessel 65 and the door 91 of the ice making room and protects the manufactured ice.

A machinery room is disposed under the cabinet. The compressor 51 and the condenser 53 are installed in the machinery room. The ice maker is driven and heat which is radiated from the condenser 53 is exhausted to an outlet 93. The snow ice maker cabinet is divided into several parts, so that most parts of the cabinet can be manufactured by an injection-molding method. As a result, the snow ice maker can be gentrified and mass-produced.

The user puts his/her hand on the drive switch 105 on the transparent plate in order to drive the ice maker. In the embodiment, the drive switch 105 is a proximity switch. This operation changes the state of the drive switch 105, and the microcomputer 101 detects the state change of the switch 105 and drives the snow ice maker. The state change of the switch means the change of from an on-state to an off-state or from an off-state to an on-state. When the microcomputer detects again the signal of the proximity switch 105, the microcomputer stops the driving of the ice maker. As such, the microcomputer 101 is programmed to process the state change of drive switch 105 by means of an event signal. The switch 105 may be replaced by a contact opening closing switch which directly opens or closes a current circuit. In summary, when the state change is detected as a result of checking the state of the switch 105 by the controller 100, the controller 100 controls to drive the ice maker, and then controls to stop the ice maker in a certain period of time, specifically, at a point of time when the ice vessel 65 is fully filled with the powder ice. If the state change of the switch 105 is detected while driving the ice maker, the controller controls immediately to stop the ice maker.

In the control of the driving of the ice maker, the microcomputer 101 controls a driving driver 77*s* such that the ice making water is supplied to the ice making water vessel 70 at a water level set in a water level sensor 77*c*, and thus, drives the ice making water pump 77 and valves necessary for supplying water. When the ice making water 71 in the ice making water vessel 70 is within a set water level, the microcomputer 101 drives a cooling fan of the condenser 53 and the refrigerant compressor 51 by controlling the driving driver 51*s*, and simultaneously with this, drives the ice making drum 10 by controlling a motor driving driver 90*s* of the driver 90, and turns on the ultraviolet lamp 75 by controlling the driving driver 75*s*.

Through the stop control, the driving of the ice making pump 77, the refrigerant compressor 51, the ice making drum 10, and the ultraviolet lamp 75 are stopped by controlling the driving drivers 77*s*, 51*s*, 90*s*, and 75*s*.

This control process is programmed in the microcomputer 101.

Figure 4:
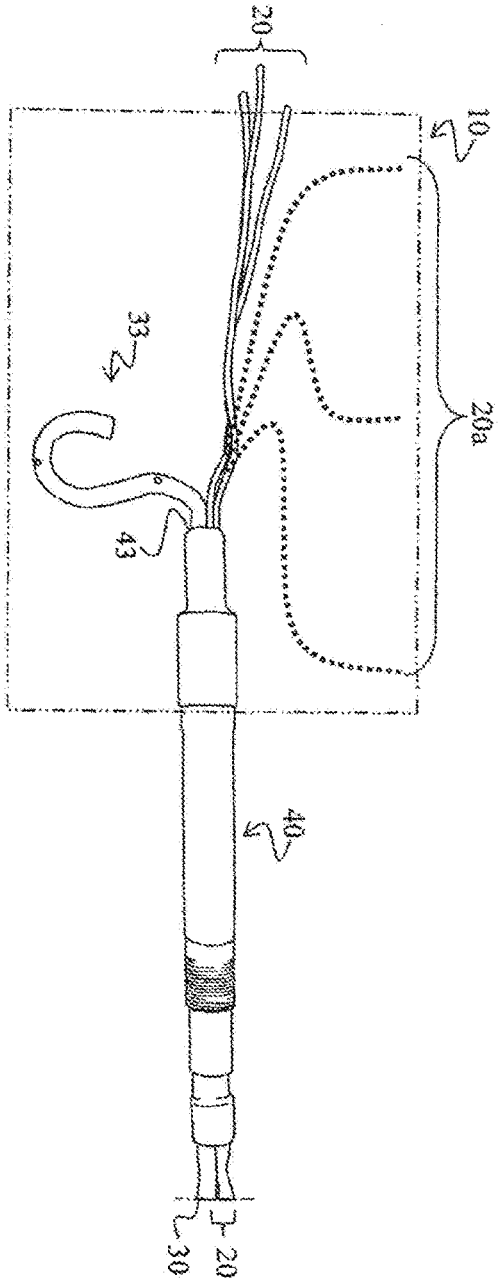
FIG. 4 is a perspective view of a coupling shaft assembly.

FIG. 4 shows a coupling shaft 40 assembly included in the ice maker. The coupling shaft 40, a plurality of capillary tubes 20, and the gas outlet tube 30 are welded by the welding part 43, so that the coupling shaft assembly forms one part. In FIG. 4, the ends of the capillary tubes 20 are assembled to the ice making drum 20 and is accurately bent in such a manner as to be disposed close (see reference numeral 20*a*) to the inner surface of the ice making drum. The ends are bent with an appropriate zigzag.

Figure 5:
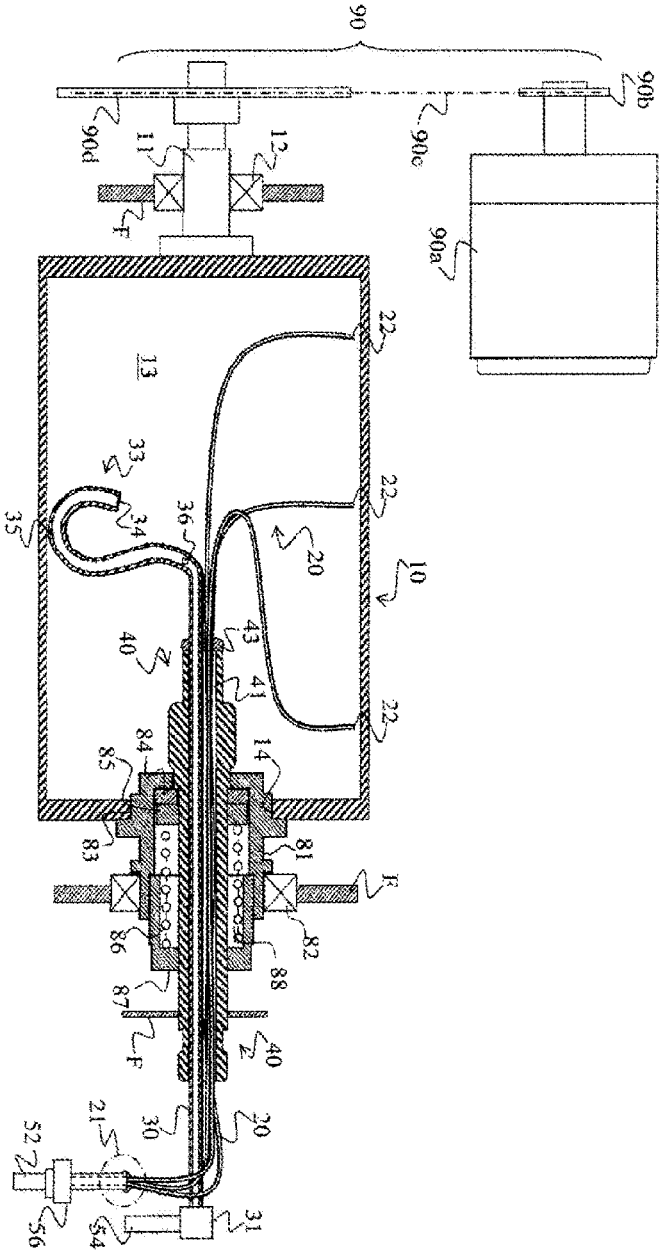
FIG. 5 is a cross sectional view showing a state where an ice making drum and the coupling shaft have been assembled to each other.

FIG. 5 is a cross sectional view showing a state where the ice making drum and the coupling shaft have been assembled to each other. In FIG. 5, the coupling shaft 40 causes a second surface of the ice making drum 10 to be supported by the frame F through the intermediation of the seat tube 81, and simultaneously with this, creates a refrigerant circulation path in the ice making drum 10 through the central passage 41. Specifically, the coupling shaft 40 is inserted into the center of the seal tube 81, and the outside of the coupling shaft 40 is supported in a horizontal fluid state by the frame F.

The seal tube 81 is assembled to the second surface of the ice making drum 10. Specifically, the screw 83 of the seal tube 81, which is supported by the frame F, is inserted and fixed to the entrance 14 where the screw of the second surface of the ice making drum is located. The coupling shaft 40 passes through the center of the seal tube 81 and connects both of the compressor 51 and condenser 53 to the inner cooling room 13 of the ice making drum 10.

A seal for blocking the gas is embedded in the inner space 88 of the seal tube 81 which is opened by the cover 87. Specifically, the seal for blocking the gas includes the first room 84 which is attached to the seal tube 81 and rotates together with the seal tube 81, the second room 85 which is attached to the coupling shaft 40 and contacts with the first room 84 through the friction surface, and the spring 86 which applies a pressure to the first room 84 so as to maintain the gas blocking property in the first room 84. This seal assembly may be installed such that two sets share the spring 86 on both sides of the space 88 of the seal tube 81.

As such, the seal tube 81 is attached to the entrance 14 of the second surface of the ice making drum 10 and rotates together with the ice making drum 10. For this operation, the body of the seal tube 81 is supported on the cabinet frame F by the bearing 82.

The support shaft 11 of the first surface of the ice making drum is assembled to the cabinet frame F by the bearing 82, and then is connected and assembled to the driver 90, i.e., a power transmission device, so that the rotation power of the driver 90 rotates the ice making drum 10.

In the driver 90, a direct current speed reduction motor 90*a* is driven by the supply current of the driving driver 90*s* controlled by the microcomputer 101 of the controller 100. The rotation force of the speed reduction motor is transmitted to the support shaft 11 of the first surface of the ice making drum 10 through two chain gears 90*b* and 90*d* and chain 90*c*.

Regarding the circulation of the refrigerant, the refrigerant compressed by the compressor 51 is injected from the ends 22 of the capillary tubes to the inner surface of the ice making drum through the supply tube 52 and the capillary tubes 20. The vaporized refrigerant gas is exhausted to the condenser 53 through the multiple inlet tube 33, gas outlet tube 30 and gas inlet tube 54. The compressor 51 is comprised of a driving motor and a refrigerant compression pump. The driving current of the driving motor is on and off by the driving driver 51*s* which receives the control of the microcomputer 101.

The welding part 43 of the coupling shaft 40 causes the plurality of capillary tubes 20 and the gas outlet tube 30 which are disposed in the central passage 41 to be adhered as one part assembly. This adherence not only integrates a plurality of important parts as one part, but also securely seals the ice making drum to prevent the refrigerant gas from leaking. In the coupling shaft 40 assembly formed integrally by the welding part 43, since the capillary tubes 20 are directly disposed from the refrigerant supply tube 52 to the refrigerant injection position, complex assembling parts are omitted and the refrigerant flow path is simplified. As a result, the ice making performance is improved and a complex assembly process, assembly workers and assembly time are shortened.

As such, due to the simple flow path configuration in which the capillary tubes 20 are directly disposed from the multiple branched portion 21 assembled to the external supply tube 52 to the positions of the ends 22 of the inner surface of the ice making drum 10, the coupling shaft 40 assembly improves the cooling performance by excluding vulnerabilities that deteriorate the cooling performance of the ice making drum, upgrades the performances of the compressor and ice making drum 10, and obtains a uniform quality.

However, since a conventional ice making drum corresponding to the coupling shaft assembly has a structure in which the capillary tubes are welded and assembled to the layered pipe, the flow paths of the plurality of capillary tubes are non-uniform and a fluid resistance occurs. Accordingly, the flow and injection of the refrigerant is not uniform, and thus, the cooling performance of the ice making drum is degraded and the compressor is much damaged, so that the manufacturing cost is increased.

The supply tube 52 of the refrigerant compressor 51 and the multiple connection part 21 of the capillary tubes are assembled to the connection part 56. The outlet tube 30 and the inlet tube 54 of the condenser 53 are assembled to the connection part 31. The connection parts 56 and 31 may be comprised of coupling parts or may be formed by welding connection.

The multiple inlet tube 33 installed within the ice making drum 10 is a curved tube having a U-shape. This multiple inlet tube 33 outwardly discharges all of the remaining refrigerants including the liquefied refrigerant which has not been vaporized within the ice making drum 10, thereby preventing the cooling performance of the ice making drum from being degraded.

Specifically, the multiple inlet tube 33 includes the first inlet 34 which is a main inlet sucking the refrigerant gas at the end of the U-shaped tube, the second inlet 35 which is adjacent to the bottom of the drum and sucks the liquefied refrigerant staying on the bottom of the drum, and the third inlet 36 which is a U-shaped tube neck assisting the suction of the refrigerant gas. The third inlet may be omitted. In the multiple inlet tube 33 installed within the ice making drum of the embodiment of the present invention, even though the refrigerant which has not been vaporized within the ice making drum 10, all of the refrigerants are discharged to the condenser, so that it is possible to prevent the refrigerant from acting as a thermal insulation layer in the cooling drum 10 and from being rapidly accumulated.

In response to this, the conventional ice making drum has no consideration for collecting the liquefied refrigerant which has not been vaporized. If the refrigerant stays on the bottom of the ice making drum in a liquid state, the liquefied refrigerant acts as a thermal insulation layer and degrades the cooling performance of the ice making drum. If the remaining refrigerant is accumulated on the inner surface of the ice making drum, a permanent thermal insulation layer is made and the compressor is damaged.

A device for supplying the ice making water 71 is installed in the ice making water vessel 70. Since the ice making water 71 always maintains a certain water level in the ice making water vessel 70, it supplies the ice making water to the ice making drum. The ice making drum 10 is immersed in the ice making water 71 to a certain depth, suitably, a depth of about 1 cm. The ice making drum 10 rotates and applies the water to the surface thereof.

In the device for supplying the ice making water 71, the ice making water pump 77 which is opened and closed by the driving driver 77*s* receiving the control of the microcomputer 101 of the controller 100 draws up the water from a water source 71*s* and supplies the ice making water 71 to the ice making water vessel 70 through a hose 77*b*.

A high water level and a low water level of the ice making water are set so as to maintain a constant water level of the ice making water, and the water level sensor 77*c* for the microcomputer 101 to detect the high water level and the low water level is further installed in the ice making water vessel 70. The microcomputer 101 checks the state of the water level sensor 77*c* at the time of driving the ice making water pump 77. When it is detected that the water level is lower than the set water level, the ice making water is supplied by driving the ice making water pump 77 through the driving driver 77*s*. Through the driving of the ice making water pump 77, the water level of the ice making water 71 within the ice making water vessel 70 is increased. The microcomputer 101 repeatedly checks the water level while driving the ice making water pump 77. When the high water level is detected, the microcomputer 101 stops the driving of the ice making water pump 77. By the control of the microcomputer 101, the water level between the high water level and the low water level which are set in the sensor 77*c* is maintained in the ice making water vessel 70.

In the snow ice maker according to the embodiment of the present invention, the ice making water 71 which is supplied to the ice making water vessel 70 is frozen (71*i*) in the drum and soon is cut into the powder ice (si) by the knife 63 and is supplied as drinking water. Therefore, it is very important to maintain the clean ice making water. For this, the ultraviolet lamp 75 is installed to irradiate light on the surface of the ice making water 71.

Since the ultraviolet lamp 75 installed on the ice making water vessel 70 irradiates ultraviolet rays with a sterilization wavelength to the ice making water 71, the ice making water is sterilized. Since the ultraviolet lamp 75 irradiates ultraviolet rays to the cooling drum, the cooling drum is also sterilized. Since the microcomputer 101 of the controller 100 supplies the driving current to the ultraviolet lamp 75 by controlling the driving driver 75*s*, the ultraviolet lamp 75 is turned on or turned off.

Figure 6:
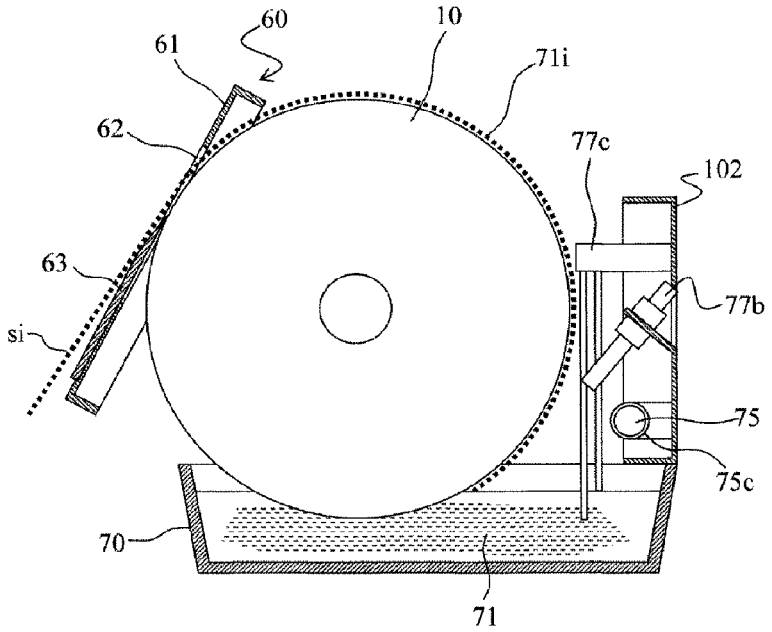
FIG. 6 is a view showing that a cutter, a water level sensor, an ice making water supply hose, and an ultraviolet lamp have been assembled.

As shown in FIG. 6, the ultraviolet lamp 75 may be installed on a frame 102 of the controller 100, which is added to the ice making water vessel 70. The frame 102 of the controller 100 is used to install a PCB board including the microcomputer 101 in which the control has been programmed. A power socket 75*c* of the ultraviolet lamp 75 as well as the water level sensor 77*c* and the water supply hose 77*b* may be installed on the frame.

Figure 7:
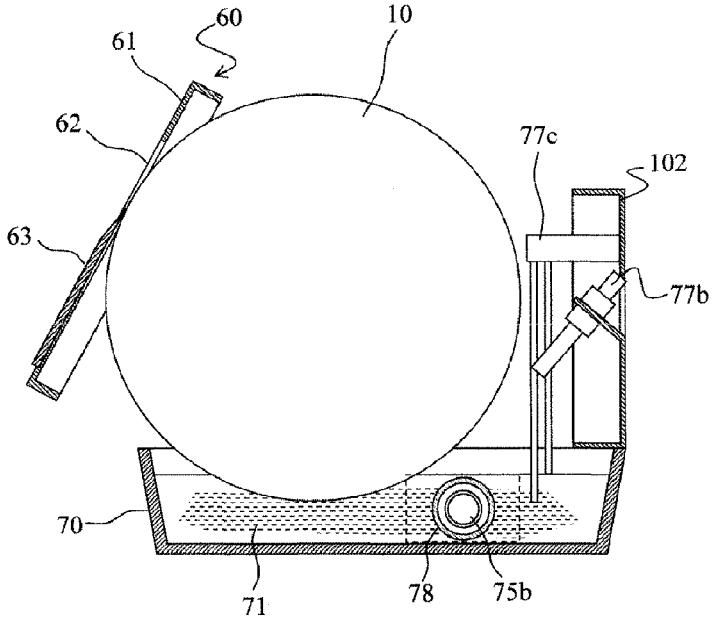
FIG. 7 is a view showing that the ultraviolet lamp has been assembled in another way.

In the installation of the ultraviolet lamp 75, it is, as shown in FIG. 7, possible that the transparent tube 78 traversing the ice making water 71 is installed in the ice making water vessel 70, and then the ultraviolet lamp 75*b* is installed within the tube 78.

In FIG. 6, the ice cutter 60 includes the cutter frame 61 which is assembled to both ends of the cabinet frame F, the cut opening 62 installed in the frame, and the knife 63 which is attached in such a manner that the cutting edge thereof forms a cutting angle with the outer surface of the ice making drum. When the water applied to the drum is frozen by the rotation of the ice making drum 10, the ice layer 71*i* is cut by the knife 63 and the cut powder ice (si) is collected in the ice vessel 65.

Figure 9:
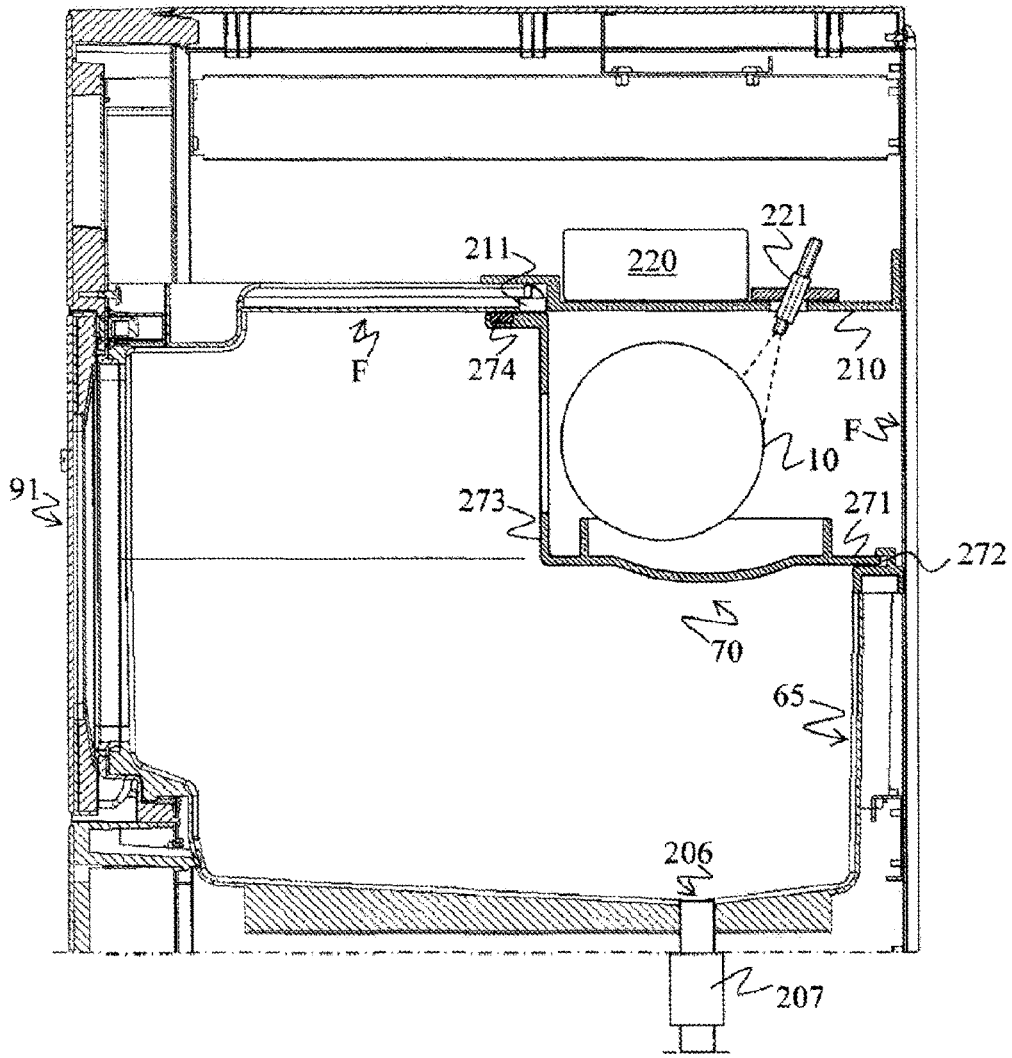
FIG. 9 is an outline view showing a cleaning device.
Figure 10:
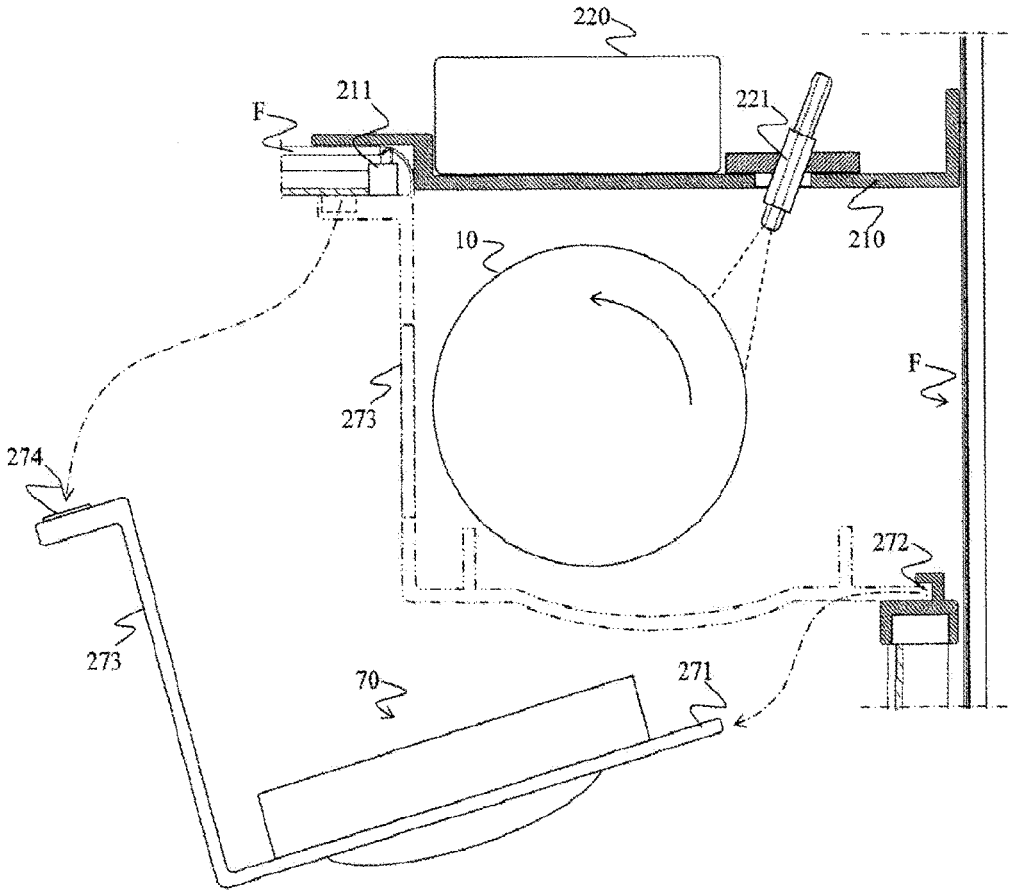
FIG. 10 is a detailed cross sectional view of the cleaning device.
Figure 11:
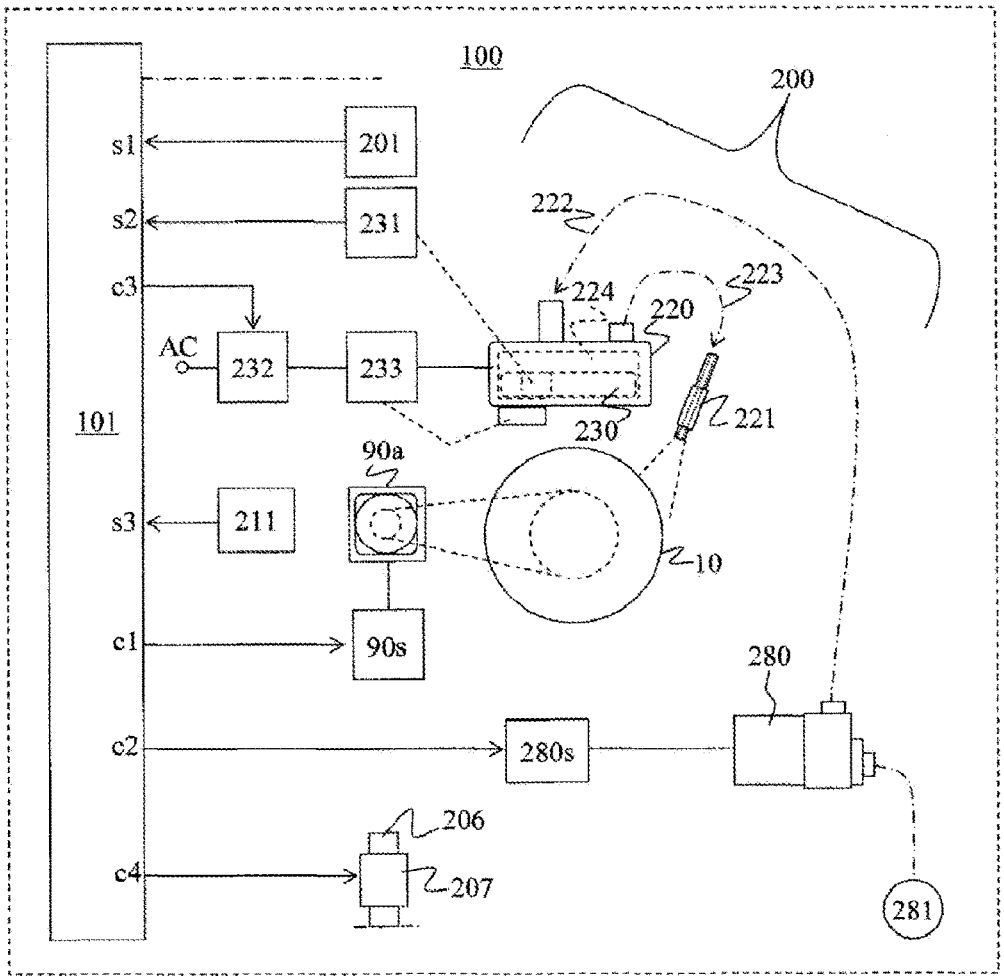
FIG. 11 is a view of a control circuit of the cleaning device, which is added to the control circuit of FIG. 8.

In FIGS. 9 to 11, the washing device 200 is further provided in the ice making drum 10 in order to wash the ice making drum 10. The washing device 200 includes the drain 206 which is installed on the bottom of the ice vessel 65, the vapor generator 220 which is installed above the ice making drum 10, the cleaning nozzle 221 which injects the water and vapor to the ice making drum 10, the wash water pump 280 which supplies washing water to the vapor generator 220, and the cleaning start switch 201 which is connected to the microcomputer 101 and provides a cleaning signal s1.

The cleaning nozzle 221 is installed on the injection support 210 located above the ice making drum 10 such that the heated water and vapor which are supplied from the vapor generator 220 through the injection tube 223 are injected into the surface of the ice making drum 10. Several cleaning nozzles 221 are installed according to the length of the ice making drum. The cleaning nozzles 221 may be installed at an interval of from 3 to 5 cm and may be densely or sparsely installed if necessary. In the embodiment, the cleaning nozzles 221 are installed at an interval of 4 cm.

In the ice making water vessel 70 which is installed between the ice making drum 10 and the ice vessel 65, the inner rim 271 of the ice making water vessel 70 is inserted into the recess 272 formed in the frame F and supports the inside of the vessel such that the ice making water vessel 70 can be easily separated outwardly from the cabinet during the cleaning. Simultaneously, the support plate 273 is extended to the outside of the ice making water vessel and the end of the support plate 273 is adsorbed and fixed to an iron plate of the ice maker frame F by means of the magnet 274.

The ice making water vessel 70 is separated by detaching the magnet 274 of the end of the support plate 273 from the iron plate frame F and by pulling forward. Here, the inner rim 271 comes out of the recess 272, so that the ice making water vessel 70 is separated from the frame. The assembling is made in a reverse order to that of the separation and is very simple.

The wash water pump 280 is connected to the microcomputer 101 and is installed such that the driving current is opened and closed through the driving driver 280*s* which is controlled by the wash water pump control signal c2.

The vapor generator 220 is connected to the water inlet tube 222 for supplying the water to the heating room 224 from the wash water pump 280 and is connected to the injection tube 223 for supplying the water and vapor heated in the heating room to the cleaning nozzle 221. The electric heater 230 is embedded in the heating room 224. The electric heater 230 heats the water supplied through the water inlet tube 222. The heated water or vapor is supplied to the cleaning nozzle 221 through the injection tube 223. For this, the electric heater 230, together with the temperature sensor 231 which is connected to the microcomputer 101 and provides the temperature signal s2 to the microcomputer 101, is embedded.

The electric heater 230 is driven by receiving a driving current (AC) through the temperature fuse 233 and the heater switch 232 which is opened and closed by the heater control signal c3 of the microcomputer 101 for the purpose of maintaining a set temperature. Therefore, the electric heater 230 maintains a set temperature range. Specifically, the microcomputer 101 detects a detected temperature of the temperature sensor 231 as a temperature signal s2 while driving the electric heater 230, and thus, performs a control for maintaining the set temperature. For example, when the temperature is higher than 400° C., the microcomputer 101 controls the heater switch 232 to be in a power-off state, and when the temperature decreases again, the microcomputer 101 controls the heater switch 232 to be in a power-on state. The set temperature can be used within a range between 300 and 500° C. Also, in the electric heater 230, since the temperature fuse 233 is connected in series to a current supply circuit of the electric heater, the temperature fuse is short-circuited in an abnormal overheating condition, so that the driving current is blocked. Therefore, an accident caused by overheating can be prevented.

The wash water pump 280 is connected to the microcomputer 101 and is installed such that the driving current is opened and closed through the driving driver 280*s* which is controlled by the control signal c2. When the wash water pump 280 is driven, the wash water 281 is supplied to the heating room 224 along the water inlet tube 222, and then the water passing through the heating room is discharged from the nozzle 221 along the injection tube 223. Here, since the electric heater 230 is driven, the hot water is heated in the heating room 224 and the heated water and vapor are discharged. It is desirable that the temperature of the heated water is higher than 85° C. so as to maintain the washing and sterilizing operations. This temperature may be increased or decreased according to the temperature setting of the heater.

In the control of the wash water pump 280 by the microcomputer 101, the washing efficiency of the ice making drum 10 can be improved by controlling the intensity of the driving of the wash water pump. If a large amount of the water is supplied to the heating room 224, all of this water cannot be vaporized, and thus, a large amount of the water is generally injected from the cleaning nozzle 221. When an appropriate small amount of the water is supplied to the heating room 224 and the electric heater 230 is hot at a sufficient heating temperature, all of the water is turned into hot vapor and the hot vapor is fiercely discharged from the cleaning nozzle 221. By using this operation, the microcomputer 101 controls the intensity of the driving current of the wash water pump 280. As a result, the water may be injected from the nozzle, the vapor may be injected from the nozzle, or both the water and fire may be injected from the nozzle.

Specifically, during the cleaning time of the ice making drum 10, the microcomputer 101 controls the wash water pump 280 such that, first, the water is mainly injected from the cleaning nozzle 221, and then the vapor is mainly injected from the cleaning nozzle 221, then the water is mainly injected from the cleaning nozzle 221, thereby maximizing the efficiencies of washing and thermal disinfection of the ice making drum 10. In the above three step control of the wash water pump 280, when the cleaning time is 30 seconds, the operation time of 10 seconds are assigned to each of the three steps.

In the washing device, in order to prevent that the cleaning process is performed in a state where the ice making water vessel 70 has been assembled, the ice making water vessel 70 is assembled in a structure which can be separated from the frame F. Also, in order to prevent that the cleaning process is performed in a state where the ice making water vessel 70 has been assembled, the ice making water vessel detection switch 211 is installed on the ice maker frame F and is connected to the microcomputer 101, so that the microcomputer 101 is allowed to make reference to the ice making water vessel detection signal s3.

Figure 8:
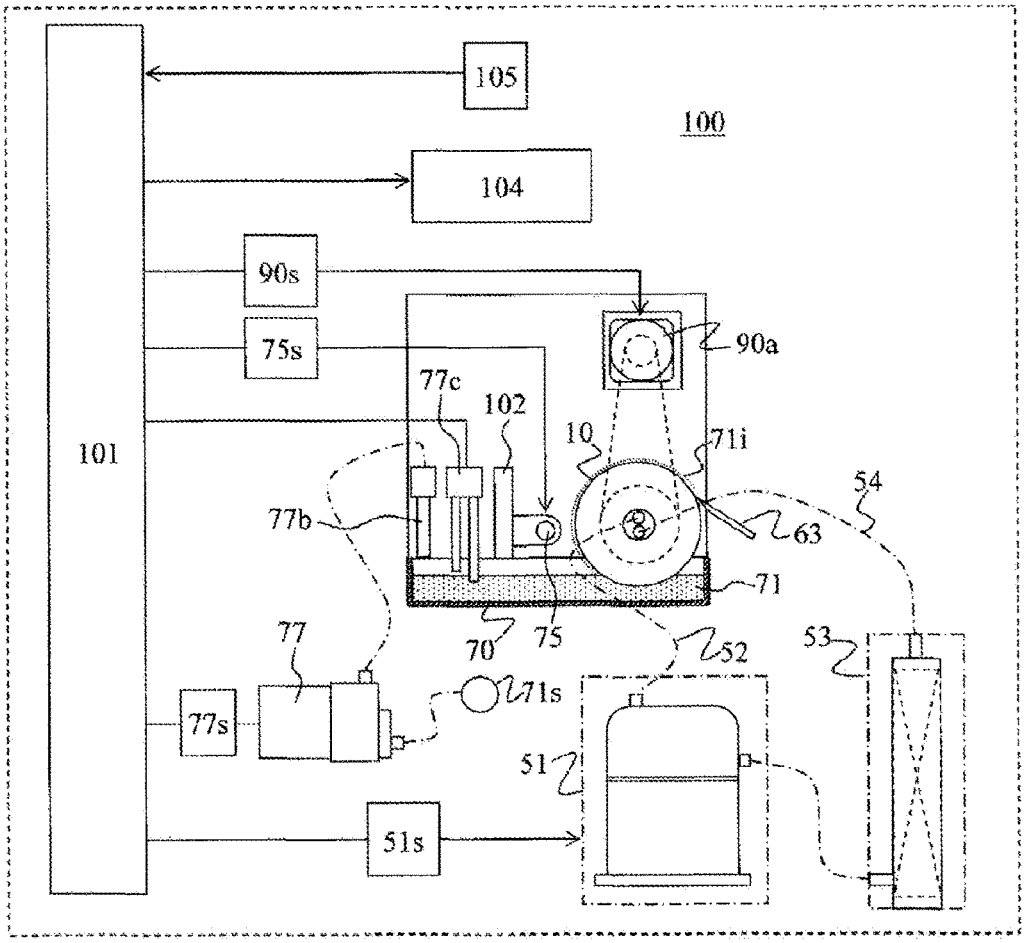
FIG. 8 is a view showing a control circuit.

The microcomputer 101 of the controller 100 is, as shown in FIG. 11, further programmed in a keyword I of the ice maker of FIG. 8 such that the following cleaning control II is performed. The following description focuses on the cleaning control II of the controller 100.

In a loop of the keyword I of the ice maker, the microcomputer 101 checks whether the state of the washing switch 201 is the cleaning request signal s1 or not. If the signal is a switch-off signal, the microcomputer 101 returns to the loop of the keyword I. Unlike this, if the signal is a switch-on signal, the microcomputer 101 rechecks the ice making water vessel detection switch 211. If the ice making water vessel detection signal s3 is in a switch-on state, the microcomputer 101 returns to the loop of the keyword I. Contrary to this, if the ice making water vessel detection signal s3 is in a switch-off state, the microcomputer 101 calls and performs the cleaning control II.

In a loop of the cleaning control II, the microcomputer 101 drives the heater 230 by providing the heater control signal c3 to the heater switch 232. The microcomputer 101 drives the wash water pump 280 by providing the wash water pump control signal c2 to the driving driver 280*s*. Also, the microcomputer 101 drives the ice making drum 10 by providing the ice making drum control signal c1 to the driving driver 90*s*. Additionally, the microcomputer 101 opens the drain valve 207 by providing the control signal c4 to the drain valve 207 of the drain 206.

In this state, the water and vapor heated in the cleaning nozzle 221 is sprayed onto the rotating ice making drum 10, and thus, the cleaning and sterilizing are performed, and then the water used in the cleaning is drained into the drain 206. As such, the heated water and vapor is sprayed onto the rotating ice making drum 10, so that the washing and thermal disinfection are simultaneously performed by the hot water and vapor, and the water sprayed onto the ice making drum 10 is drained into the drain. A time required for the cleaning control is 20 to 60 seconds. The shortest time is 20 seconds. When the cleaning time elapses, the microcomputer 101 stops the driving of the electric heater 230 by providing the heater control signal c3 to the heater switch 232, stops the driving of the wash water pump 280 by providing the wash water pump control signal c2 to the driving driver 280*s*, and stops the driving of the ice making drum 10 by providing the ice making drum control signal c1 to the driving driver 90*s*.

Here, the drain 206 is still opened. This intends to drain all remaining water. At a point of time when 40 to 80 seconds have further elapsed, the microcomputer 101 closes the drain valve 207 by providing the control signal c4 to the drain valve 207 of the drain 206. Through this process, the cleaning is ended and the control returns to the keyword I. The control signals are a high-low signal or a two or more bit bitmap signal Before the cleaning control is performed, it is possible to add related controls, for example, checking the states of the devices such as the compressor, etc., equipped to the ice maker, or stopping the driving.

The washing of the ice making drum is ended by the above process. The ice making water vessel 70 is assembled to the ice maker and the ice making can be performed again in a clean state.

What is claimed is:

1. A snow ice maker comprising an ice making drum which is installed horizontally to a cabinet frame, a driver assembled to a first surface of the ice making drum, a seal tube assembled to a second surface of the ice making drum, a refrigerant compressor, a means for circulating the refrigerant within the ice making drum, a refrigerant gas condenser, an ice making water vessel, a cutter which cuts an ice layer on the surface of the ice making drum, wherein the means for circulating the refrigerant within the ice making drum comprises:

a coupling shaft assembly in which refrigerant injection capillary tubes and a refrigerant gas outlet tube are disposed in a central passage and simultaneously, the capillary tubes and the refrigerant gas outlet tube are integrally attached by a welding part, so that the passage is sealed;

an arrangement structure of the capillary tubes, in which the capillary tubes of which ends are disposed close to an injection position of the inner wall of the cooling drum, are collected to the passage of the coupling shaft and are extended to the outside of the cooling drum, and then are directly connected to a refrigerant supply tube of the refrigerant compressor by a multiple connection part; and an arrangement structure of the outlet tube in which the outlet tube connected to a multiple inlet tube within the ice making drum is extended to the outside of the cooling drum through central passage of the coupling shaft and is directly connected to a gas inlet tube of the condenser by a connection part.

2. The snow ice maker of claim 1, wherein the multiple inlet tube installed within the ice making drum is a curved tube having a U-shape and comprises a first inlet which exhausts the refrigerant gas at the end thereof and a second inlet which sucks the refrigerant staying on the bottom of the drum.

3. The snow ice maker of claim 1, further comprising an ultraviolet lamp installed to irradiate the water contained in the ice making water vessel, wherein the ultraviolet lamp is installed horizontally to a support plate at the rear of the drum and irradiates ultraviolet rays to the surface of the ice making drum and the surface of the ice making water.

4. The snow ice maker of claim 1, wherein a transparent tube traversing the ice making water is installed in the ice making water vessel, and an ultraviolet lamp is installed within the transparent tube, so that ultraviolet rays are irradiated to the ice making water.

5. The snow ice maker of claim 1, wherein, when a state change is detected as a result of checking the state of a switch by a microcomputer of a controller, the microcomputer is programmed to control the driving of the ice maker during a predetermined period of time, and then controls to stop the ice maker, and when the state change of the switch is detected while driving the ice maker, the microcomputer is programmed to control to stop the ice maker without waiting for the remaining time, wherein, in controlling the ice maker, the microcomputer controls a driving driver such that the ice making water is supplied to the ice making water vessel at a water level set in a water level sensor, and thus, drives an ice making water pump, and when the ice making water in the ice making water vessel is within a set water level, the microcomputer drives a refrigerant compressor by controlling a driving driver, and drives the ice making drum by controlling a motor driving driver, and simultaneously, drives an ultraviolet lamp, and wherein, through the stop control, the driving of the ice making pump, a refrigerant compressor, the ice making drum, and the ultraviolet lamp are stopped by controlling the driving drivers.

6. A snow ice maker comprising an ice making drum which is installed horizontally to a cabinet frame, a driver assembled to a first surface of the ice making drum, a seal tube assembled to a second surface of the ice making drum, a refrigerant compressor, a means for circulating the refrigerant within the ice making drum, a refrigerant gas condenser, an ice making water vessel, a cutter which cuts an ice layer on the surface of the ice making drum, wherein the means for circulating the refrigerant within the ice making drum comprises:

a coupling shaft assembly in which refrigerant injection capillary tubes and a refrigerant gas outlet tube, are disposed in a central passage and simultaneously, the capillary tubes and the refrigerant gas outlet tube are integrally attached by a welding part, so that the passage is sealed;

an arrangement structure of the capillary tubes, in which the capillary tubes of which ends are disposed close to an injection position of the inner wall of the cooling drum are collected to the passage of the coupling shaft and are extended to the outside of the cooling drum, and then are directly connected to a refrigerant supply tube of the refrigerant compressor by a multiple connection part; and an arrangement structure of the outlet tube in which the outlet tube connected to a multiple inlet tube within the ice making drum is extended to the outside of the cooling drum through central passage of the coupling shaft and is directly connected to a gas inlet tube of the condenser by a connection part, and wherein a washing device is further provided in the ice making drum.

7. The snow ice maker of claim 6, wherein the washing device includes a drain which is installed on the bottom of an ice vessel, a vapor generator which is installed above the ice making drum, a cleaning nozzle which injects the water and vapor to the ice making drum, a wash water pump which supplies washing water to the vapor generator, and the cleaning start switch which is connected to a microcomputer and provides a cleaning signal, wherein the cleaning nozzle is installed on an injection support 210 located above the ice making drum such that the heated water and vapor which are supplied from the vapor generator through an injection tube are injected into the surface of the ice making drum, wherein, in the ice making water vessel which is installed between the ice making drum and the ice vessel, an inner rim of the ice making water vessel is inserted into a recess formed in a frame and supports the inside of the vessel to the frame such that the ice making water vessel can be easily separated outwardly from the cabinet during the cleaning, and simultaneously, a support plate 273 is extended to the outside of the ice making water vessel and the end of the support plate is adsorbed and fixed to an iron plate of the ice maker frame by means of a magnet, and wherein the wash water pump for supplying the wash water is connected to the microcomputer and is installed such that a driving current is opened and closed through a driving driver which is controlled by a wash water pump control signal.

8. The snow ice maker of claim 7, wherein the vapor generator is connected to a water inlet tube for supplying the water to a heating room from the wash water pump for supplying the wash water and is connected to the injection tube for supplying the water and vapor heated in the heating room to the cleaning nozzle, wherein an electric heater, together with the temperature sensor which is connected to the microcomputer and provides the temperature signal to the microcomputer, is embedded in the heating room such that the water supplied through the water inlet tube is heated, and then the heated water or vapor is supplied to the cleaning nozzle through the injection tube wherein the electric heater receives a driving current (AC) through a temperature fuse and a heater switch which is opened and closed by a heater control signal e of the microcomputer, wherein the wash water pump is connected to the microcomputer and is installed such that a driving current is supplied through a driving driver which is controlled by the control signal, and wherein an ice making water vessel detection switch of which the state is changed when the ice making water vessel is separated is installed on the ice maker frame F and is connected to the microcomputer, so that the microcomputer is allowed to make reference to an ice making water vessel detection signal.

9. The snow ice maker of claim 7, wherein the microcomputer of a controller is further programmed in a keyword of the ice maker in such a manner as to perform the following cleaning control, wherein the cleaning control is that, in a loop of a keyword I of the ice maker, the microcomputer checks whether the state of the washing switch is the cleaning request signal or not, and if the signal is a switch-off signal, the microcomputer returns to the loop of the keyword, and if the signal is a switch-on signal, the microcomputer rechecks the ice making water vessel detection switch, and then if an ice making water vessel detection signal is in a switch-on state, the microcomputer returns to the loop of the keyword, and if the ice making water vessel detection signal is in a switch-off state, the microcomputer calls and performs a cleaning control II, wherein, in a loop of the cleaning control II, the microcomputer drives a heater by providing a heater control signal to a heater switch, drives the wash water pump by providing the wash water pump control signal a to the driving driver, wherein the microcomputer drives the ice making drum by providing an ice making drum control signal cl to a driving driver, and opens a drain valve by providing a control signal to the drain valve of the drain, wherein the heated water and vapor is sprayed onto the rotating ice making drum, so that the washing and thermal disinfection are simultaneously performed by the hot water and vapor, and the water sprayed for cleaning is caused to be drained into the drain, wherein, when a time of 20 to 60 seconds required for the cleaning control elapses, the microcomputer stops the driving of the electric heater by providing the heater control signal to the heater switch, and stops the driving of the wash water pump by providing the wash water pump control signal to the driving driver, wherein the microcomputer stops the driving of the ice making drum by providing the ice making drum control signal to the driving driver, and wherein, at the point of time when 40 to 80 seconds have further elapsed, the microcomputer closes the drain valve by providing the control signal to the drain valve of the drain, and then the microcomputer ends the cleaning and returns to the keyword I.

* * * * *